US012024888B2

(12) United States Patent
Shiao et al.

(10) Patent No.: US 12,024,888 B2
(45) **Date of Patent: *Jul. 2, 2024**

(54) ROOFING SYSTEMS WITH IMPROVED WIND PERFORMANCE OF ROOFING TILES AND METHODS OF INSTALLING THEREOF

(71) Applicant: BMIC LLC, Dallas, TX (US)

(72) Inventors: Ming-Liang Shiao, Basking Ridge, NJ (US); Brian Lee, Linden, NJ (US); Daniel E. Boss, Morris Township, NJ (US); Ramil Marcelo L. Mercado, Waxahachie, TX (US)

(73) Assignee: BMIC LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/310,912

(22) Filed: May 2, 2023

(65) Prior Publication Data

US 2023/0265660 A1 Aug. 24, 2023

Related U.S. Application Data

(63) Continuation of application No. 17/580,800, filed on Jan. 21, 2022, now Pat. No. 11,680,410.

(60) Provisional application No. 63/140,284, filed on Jan. 22, 2021.

(51) Int. Cl.

| | |
|---|---|
| ***E04D 1/36*** | (2006.01) |
| ***E04D 1/00*** | (2006.01) |
| ***E04D 1/12*** | (2006.01) |
| ***E04D 1/28*** | (2006.01) |

(52) U.S. Cl.

CPC ..... *E04D 1/36* (2013.01); *E04D 1/12* (2013.01); *E04D 1/28* (2013.01); *E04D 1/2928* (2019.08)

(58) Field of Classification Search

CPC .... E04D 1/36; E04D 1/12; E04D 1/28; E04D 1/2928

See application file for complete search history.

(56) References Cited

U.S. PATENT DOCUMENTS

| | | | |
|---|---|---|---|
| 5,533,313 | A | 7/1996 | Pike et al. |
| 8,206,807 | B2 | 6/2012 | Friedman et al. |
| 8,661,760 | B2 | 3/2014 | Williams et al. |
| 8,973,310 | B1 | 3/2015 | Henderson |
| 9,097,021 | B1 | 8/2015 | Williams et al. |
| 9,267,296 | B2 | 2/2016 | Maurer et al. |

(Continued)

OTHER PUBLICATIONS

International Search Report and Written Opinion for International Patent Application No. PCT/US22/13243 dated Apr. 11, 2022.

*Primary Examiner* — Patrick J Maestri
(74) *Attorney, Agent, or Firm* — Venable LLP

(57) ABSTRACT

This invention, in embodiments, relates to a roofing system comprising (a) a roofing substrate having a roofing surface, (b) a first roofing tile overlying the roofing surface, the first roofing tile having a front surface, a back surface, a top edge, and a bottom edge, and (c) a second roofing tile overlying the first roofing tile, the second roofing tile having a front surface, a back surface, a top edge, and a bottom edge. At least one sealant line is applied to (i) the back surface of the second roofing tile in an area that overlays the first roofing tile, (ii) the front surface of the first roofing tile in an area in which the second roofing tile overlays the first roofing tile, or (iii) both (i) and (ii). The at least one sealant line is configured to adhere the second roofing tile to the first roofing tile.

17 Claims, 6 Drawing Sheets

(56) References Cited

U.S. PATENT DOCUMENTS

| | | | |
|---|---|---|---|
| 9,631,383 | B1 | 4/2017 | Mathieson |
| 10,358,824 | B2 | 7/2019 | Aschenbeck et al. |
| 2001/0001404 | A1 | 5/2001 | Starr |
| 2004/0107664 | A1 | 6/2004 | Rodrigues |
| 2004/0200174 | A1 | 10/2004 | Register |
| 2004/0206035 | A1 | 10/2004 | Kandalgaonkar |
| 2007/0022692 | A1 | 2/2007 | Friedman et al. |
| 2013/0025225 | A1 | 1/2013 | Vermilion et al. |
| 2015/0240495 | A1 | 8/2015 | Vermilion et al. |
| 2016/0145869 | A1 | 5/2016 | Leitch et al. |
| 2017/0037629 | A1 | 2/2017 | Srivastava et al. |
| 2017/0058528 | A1 | 3/2017 | Verhoff et al. |
| 2018/0135302 | A1 | 5/2018 | Verhoff et al. |
| 2018/0313087 | A1 | 11/2018 | Patki et al. |
| 2020/0141122 | A1 | 5/2020 | Whitridge, Jr. et al. |
| 2021/0164228 | A1 | 6/2021 | Fu et al. |

ROOFING SYSTEMS WITH IMPROVED WIND PERFORMANCE OF ROOFING TILES AND METHODS OF INSTALLING THEREOF

RELATED APPLICATION

This application is a continuation of U.S. patent application Ser. No. 17/580,800, filed Jan. 21, 2022, which claims the priority of U.S. provisional application Ser. No. U.S. 63/140,284, entitled "Roofing Systems with Improved Wind Performance of Roofing Tiles and Methods of Installing Thereof" filed Jan. 22, 2021, which are incorporated herein by reference in their entirety for all purposes.

FIELD OF THE INVENTION

This invention relates to roofing systems comprising roofing tiles with increased wind uplift resistance and methods of installing such roofing tiles. The roofing tiles include at least one sealant line, including, e.g., a heat-activated or self-activated sealant, that is configured to adhere the roofing tiles to another roofing tile. Roofing tiles that include this sealant configuration exhibit superior properties of, for example, increased wind uplift resistance, as compared to roofing tiles without such a sealant.

BACKGROUND OF THE INVENTION

A large variety of roofing tiles exist in the marketplace. Typically, roofing tiles are made from natural materials, such as, e.g., clay, concrete, ceramics (including brick and fired clay), slate, and/or stone. Common methods of installing such roofing tiles include the use of various interlocking and/or mounting mechanisms. Non-interlocking synthetic tiles have been used as an alternative to concrete or clay tiles due to their lightweight, low breakage during transportation, easier installation, and comparable aesthetics. For this type of roofing material, the synthetic tiles can be nailed directly to the roof deck for faster installation. However, the installed system can suffer from decreased wind performance if the tile has large exposure to wind and/or if the tile has limited strength to resist the wind uplift force. This decrease in wind performance is generally due to (i) the tiles being non-interlocking and/or (ii) wind getting underneath the tile and creating uplift forces that can damage the tile in a high wind event.

There is therefore a need for a roofing system comprising roofing tiles and a method of installation that includes a means for adhering the roofing tiles to a roofing surface to thereby increase wind uplift resistance of the roofing tiles.

SUMMARY OF THE INVENTION

One embodiment of this invention pertains to a roofing system comprising (a) a roofing substrate having a roofing surface, (b) a first roofing tile overlying the roofing surface, the first roofing tile having a front surface, a back surface, a top edge, and a bottom edge, and (c) a second roofing tile overlying the first roofing tile, the second roofing tile having a front surface, a back surface, a top edge, and a bottom edge. At least one sealant line is applied to (i) the back surface of the second roofing tile in an area that overlays the first roofing tile, (ii) the front surface of the first roofing tile in an area in which the second roofing tile overlays the first roofing tile, or (iii) both (i) and (ii). The at least one sealant line is configured to adhere the second roofing tile to the first roofing tile, and the second roofing tile does not adhere to the roofing surface via a sealant.

In one embodiment, the roofing substrate comprises a roof deck substrate, a roof deck substrate to which one or more underlayment material layers have been attached, and combinations thereof.

In one embodiment, at least one sealant line is applied to (i) the back surface of the first roofing tile in an area that is adjacent to the bottom edge of the first roofing tile, (ii) the front surface of the first roofing tile in an area that is adjacent to the top edge of the first roofing tile, or (iii) both (i) and (ii).

In one embodiment, at least one sealant line is applied to (i) the back surface of the second roofing tile in an area that is adjacent to the bottom edge of the second roofing tile, (ii) the front surface of the second roofing tile in an area that is adjacent to the top edge of the second roofing tile, or (iii) both (i) and (ii).

In one embodiment, the at least one sealant line comprises at least one of (i) a heat-activated sealant or (ii) a self-activated sealant.

In one embodiment, at least one of the first roofing tile and the second roofing tile includes a release agent. In some embodiments, the release agent is applied to (i) the front surface of the at least one of the first roofing tile and the second roofing tile, (ii) the back surface of the at least one of the first roofing tile and the second roofing tile, or (iii) both (i) and (ii). In an embodiment, the release agent has a low affinity to the at least one sealant line. In some embodiments, the release agent comprises one or more of a silicone, siliconate dispersions, a fluoropolymer, a soap, a wax, a metal salt, or a surface with a texture to create a low surface energy effect.

In some embodiments, the first roofing tile and the second roofing tile are non-interlocking.

In some embodiments, the first roofing tile and the second roofing tile comprise synthetic tiles.

In one embodiment, the first roofing tile and the second roofing tile are attached to the roofing surface via fasteners.

In one embodiment, the front (or top) surface of the first roofing tile and the front (or top) surface of the second roofing tile are free of a sealer.

In some embodiments, the at least one sealant line comprises a discontinuous line.

In one embodiment, the at least one sealant line has a thickness of from 5 mils to 200 mils.

In one embodiment, the at least one sealant line exhibits a minimum activation temperature (° F.) (tan $\delta>1$) of less than 40° F.

In one embodiment, the roofing system passes the ASTM D3161 test at 110 mph for 2 hours.

In some embodiments, the at least one sealant line comprises at least one of an asphaltic sealant, a polymer modified asphaltic sealant, a butyl adhesive, an acrylic adhesive, a polyurethane adhesive, a pressure sensitive adhesive, an epoxy, a foam adhesive, a hot melt adhesive, and combinations thereof.

Another embodiment of this invention pertains to a method of installing roofing tiles onto a roofing substrate having a roofing surface. The method comprises (a) obtaining a first roofing tile, the first roofing tile having a front surface, a back surface, a top edge, and a bottom edge, (b) obtaining a second roofing tile, the second roofing tile having a front surface, a back surface, a top edge, and a bottom edge, (c) applying at least one sealant line to (i) the back surface of the second roofing tile in an area that overlays the first roofing tile, (ii) the front surface of the first roofing tile in an area in which the second roofing tile overlays the first roofing tile, or (iii) both (i) and (ii), and (d) installing the first and second roofing tiles to the roofing surface, such that the second roofing tile overlays at least a portion of the first roofing tile. The at least one sealant line is configured to adhere the second roofing tile to the first roofing tile, and the second roofing tile does not adhere to the roofing surface via a sealant.

In one embodiment, the roofing substrate comprises a roof deck substrate, a roof deck substrate to which one or more underlayment material layers have been attached, and combinations thereof.

In one embodiment, the step of applying at least one sealant line comprises applying at least one sealant line to (i) the back surface of the first roofing tile in an area that is adjacent to the bottom edge of the first roofing tile, (ii) the front surface of the first roofing tile in an area that is adjacent to the top edge of the first roofing tile, or (iii) both (i) and (ii).

In one embodiment, the step of applying at least one sealant line comprises applying at least one sealant line to (i) the back surface of the second roofing tile in an area that is adjacent to the bottom edge of the second roofing tile, (ii) the front surface of the second roofing tile in an area that is adjacent to the top edge of the second roofing tile, or (iii) both (i) and (ii).

In one embodiment, the at least one sealant line comprises at least one of (i) a heat-activated sealant or (ii) a self-activated sealant.

In one embodiment, the method further comprises applying a release agent to at least one of the first roofing tile and the second roofing tile. In some embodiments, the step of applying the release agent comprises applying the release agent to (i) the front surface of the at least one of the first roofing tile and the second roofing tile, (ii) the back surface of the at least one of the first roofing tile and the second roofing tile, or (iii) both (i) and (ii). In an embodiment, the release agent has a low affinity to the at least one sealant line. In some embodiments, the release agent comprises one or more of a silicone, siliconate dispersions, a fluoropolymer, a soap, a wax, a metal salt, or a surface with a texture to create a low surface energy effect.

In some embodiments, the step of applying at least one sealant line comprises applying the at least one sealant line as a discontinuous line.

In one embodiment, the method further comprises attaching the first roofing tile and the second roofing tile to the roofing surface via fasteners.

In one embodiment, the first roofing tile and the second roofing tile are at least one of (i) non-interlocking tiles and (ii) synthetic tiles.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

One embodiment of this invention pertains to a roofing system comprising (a) a roofing substrate having a roofing surface, (b) a first roofing tile overlying the roofing surface, the first roofing tile having a front surface, a back surface, a top edge, and a bottom edge, and (c) a second roofing tile overlying the first roofing tile, the second roofing tile having a front surface, a back surface, a top edge, and a bottom edge. At least one sealant line is applied to (i) the back surface of the second roofing tile in an area that overlays the first roofing tile, (ii) the front surface of the first roofing tile in an area in which the second roofing tile overlays the first roofing tile, or (iii) both (i) and (ii). The at least one sealant line is configured to adhere the second roofing tile to the first roofing tile, and the second roofing tile does not adhere to the roofing surface via a sealant.

Figure 1A:
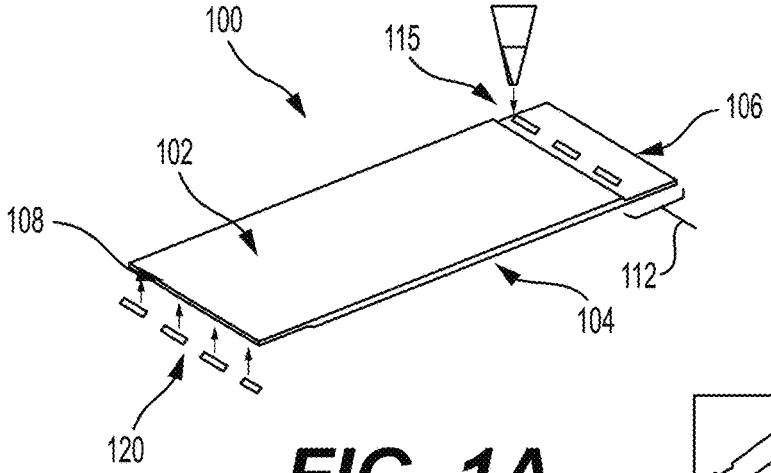
FIG. 1A is an illustration of a roofing tile with at least one sealant line according to an embodiment of the invention.
Figure 1B:
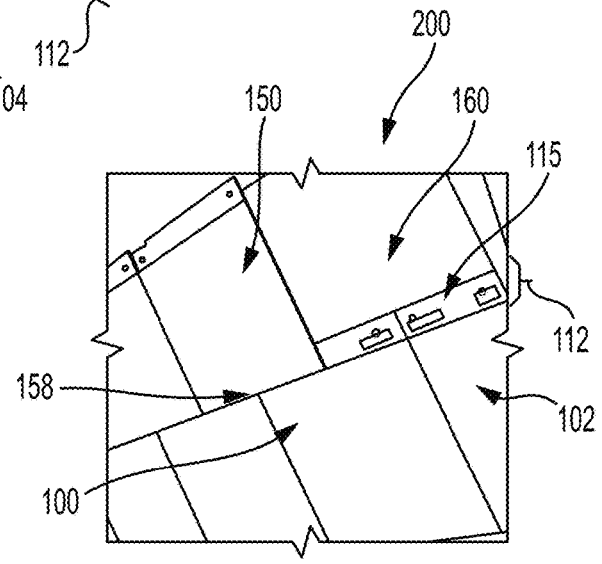
FIG. 1B is an illustration of a roofing system that includes the roofing tile illustrated in FIG. 1A, according to an embodiment of the invention.

FIGS. 1A and 1B illustrate a roofing tile 100 according to an embodiment of the invention. According to this embodiment, the roofing tile 100 includes a front surface 102, a back surface 104, a top edge 106, and a bottom edge 108. As also shown in FIG. 1A, the roofing tile 100 includes a headlap 112 near the top edge 106. As further shown in the embodiment of FIG. 1A, the roofing tile 100 includes (i) a first sealant line 115 on the front surface 102 in the area of the headlap 112 and/or (ii) a second sealant line 120 on the back surface 104 near the bottom edge 108 of the roofing tile 100. Although the embodiment of FIG. 1A illustrates at least two sealant lines (115, 120), only a single sealant line (115 or 120) could be included or more than two sealant lines could be included. In addition, although the embodiment of FIG. 1A illustrates each of the first and second sealant lines (115, 120) comprising a plurality of spaced apart lines or dots of sealant (or adhesive), i.e., the first and second sealant lines (115, 120) are discontinuous, the sealant for one or both of the first and second sealant lines (115, 120) could also be provided as a single line of sealant, multiple lines of sealant, or combinations thereof.

According to an embodiment, the sealant comprises at least one of (i) a heat-activated sealant or (ii) a self-activated sealant. For example, according to an embodiment, the self-activated sealant is a sealant that can be activated simply by the heat from the sun or ambient air after a shingle installation and does not require any additional artificial means to activate it, such as, e.g., a heat blanket, hot air gun, chemical means, or the like.

According to one embodiment, the sealant (or adhesive) provided as the first sealant line 115 and/or second sealant line 120 can be applied via any suitable process, including, for example, a wheel applicator, slot die, die coater, extrusion, spraying, or combinations thereof.

FIG. 1B illustrates an embodiment of a roofing system 200 that includes a roofing substrate having a roofing surface 160, at least a first roofing tile (i.e., the roofing tile 100 of FIG. 1A) overlying the roofing surface 160, and at least a second roofing tile 150 overlying both the roofing surface 160 and the first roofing tile 100. As shown in the embodiment of FIG. 1B, both the first roofing tile 100 and the second roofing tile 150 comprise non-interlocking tiles. As also shown in the embodiment of FIG. 1B (and similar to the embodiment of FIG. 1A), the first roofing tile 100 includes a first sealant line 115 on the front surface 102 of the first roofing tile 100 in the area of the headlap 112. As further shown in the embodiment of FIG. 1B, the second roofing tile 150 overlays the first roofing tile 100 in this area of the headlap 112 of the first roofing tile 100. By applying the first sealant line 115 on the front surface 102 of the first roofing tile 100 in the area of the headlap 112, the second roofing tile 150 can adhere to the first roofing tile 100 via the first sealant line 115. Thus, the first sealant line 115 is configured to adhere the second roofing tile 150 to the first roofing tile 100. Moreover, because the second roofing tile 150 is adhered to the first roofing tile 100 via the first sealant line 115, the second roofing tile 150 is not (nor does it need to be) adhered to the roofing surface 160 via a sealant, including, e.g., the first sealant line 115 or any other sealant line(s), sealant, adhesive or bonding material. Although the embodiment of FIG. 1B illustrates the first sealant line 115 comprising a plurality of spaced apart lines or dots of sealant (or adhesive), i.e., the first sealant line 115 is discontinuous, the sealant of the first sealant line 115 could also be provided as a single line of sealant, multiple lines of sealant, or combinations thereof. In addition, although the embodiment of FIG. 1B illustrates the first sealant line 115 being applied to the front surface 102 of the first roofing tile 100 in the area of the headlap 112, the first sealant line 115 could alternatively be provided (or another sealant line could additionally be provided) to the back surface of the second roofing tile 150 near a bottom edge 158 of the second roofing tile 150, to allow for the second roofing tile 150 to adhere to the first roofing tile 100 via this sealant line (not shown).

According to an embodiment, the at least one sealant line is configured to adhere the second roofing tile to the first roofing tile, and the second roofing tile does not adhere to the roofing surface via a sealant. According to another embodiment, the at least one sealant line is configured to adhere the second roofing tile to the first roofing tile, and the second roofing tile does not adhere to the roofing surface via the at least one sealant line. According to an embodiment, the at least one sealant line is configured to adhere the second roofing tile to the first roofing tile, and the second roofing tile does not adhere to the roofing surface via another sealant line(s). According to an embodiment, the at least one sealant line is configured to adhere the second roofing tile to the first roofing tile, and the second roofing tile does not adhere to the roofing surface via a sealant that substantially covers the back surface of the second roofing tile (e.g., 100% coverage of sealant). According to an embodiment, the at least one sealant line is configured to adhere the second roofing tile to the first roofing tile, and the second roofing tile does not adhere to the roofing surface via a sealant that covers 10% of the back surface of the second roofing tile. According to an embodiment, the at least one sealant line is configured to adhere the second roofing tile to the first roofing tile, and the second roofing tile does not adhere to the roofing surface via a sealant that covers 25% of the back surface of the second roofing tile. According to an embodiment, the at least one sealant line is configured to adhere the second roofing tile to the first roofing tile, and the second roofing tile does not adhere to the roofing surface via a sealant that covers 50% of the back surface of the second roofing tile. According to an embodiment, the at least one sealant line is configured to adhere the second roofing tile to the first roofing tile, and the second roofing tile does not adhere to the roofing surface via a sealant that covers 75% of the back surface of the second roofing tile. According to an embodiment, the at least one sealant line is configured to adhere the second roofing tile to the first roofing tile, and the second roofing tile does not adhere to the roofing surface via a sealant that covers 100% of the back surface of the second roofing tile (i.e., a complete coating or coverage of the back surface of the second roofing tile with a sealant).

According to one embodiment, the roofing substrate (e.g., the roofing substrate having the roofing surface 160 of FIG. 1B) comprises a roof deck substrate, a roof deck substrate to which one or more underlayment material layers have been attached, and combinations thereof. According to an embodiment, the roofing tiles (e.g., the first roofing tile 100 and the second roofing tile 150 of FIG. 1B) are attached to the roofing surface (e.g., the roofing substrate having the roofing surface 160 of FIG. 1B) via fasteners (not shown). The fasteners may include, for example, nails, screws, staples, anchors, bolts, hardware, nuts, pins, studs, clips, rivets, rods, sockets, retaining rings, clamps, clasps, hangers, latches, pegs, washers, etc., and combinations thereof.

According to one embodiment, the roofing tiles are non-interlocking tiles (see, e.g., the first roofing tile 100 and the second roofing tile 150 of FIG. 1B). According to another embodiment, the roofing tiles are interlocking tiles.

According to an embodiment, the roofing tiles comprise synthetic tiles. For example, according to one embodiment, the synthetic tiles comprise a thermoplastic material, including, e.g., various thermoplastic polymers, elastomers, rubbers, copolymers, and/or polyolefins, as well as blends and filled formulations of thermoplastic materials, recycled materials, and combinations thereof. The synthetic tiles can further comprise fillers, such as, e.g., sand, calcium carbonate, stone dust, wood dust, etc. The synthetic tiles can also comprise functional additives, including, for example, fire retardants, colorants, pigments, stabilizers, impact modifiers, UV absorbers, anti-oxidizers, processing aids, and combinations thereof.

According to an embodiment, the top surface of the roofing tiles (e.g., the top surface 102 of the roofing tile 100 of FIGS. 1A and 1B) is free of sealer. According to an embodiment, the roofing tiles do not require a sealer be applied to their top surfaces (e.g., the top surface 102 of the roofing tile 100 of FIGS. 1A and 1B) for water-proofing purposes.

According to one embodiment, and as discussed above, the sealant (or adhesive) (e.g., the first sealant line 115 and/or second sealant line 120 of FIG. 1A), including, e.g., a heat-activated sealant or self-activated sealant, can be applied via any suitable process, including, for example, a wheel applicator, slot die, die coater, extrusion, spraying, or combinations thereof. According to one embodiment, this application of the sealant (e.g., the first sealant line 115 and/or second sealant line 120 of FIG. 1A) can be done prior to the tile installation and preferably during the manufacturing of the tiles. According to an embodiment, the sealant (or adhesive) is applied in a discontinuous form (see, e.g., the first sealant line 115 and/or second sealant line 120 of FIG. 1A), such that water accumulated behind the sealant line can be drained out. According to an embodiment, the sealant should be placed close to the windward edge of the tile (e.g., the bottom edge 108 of the roofing tile 100 of FIG. 1A) and not be revealed after the installation. According to an embodiment, the sealant (or adhesive) is applied to the lower part of the exposed area of the tile that will make contact with the roof deck or a previously installed tile. According to this embodiment, the sealant is able to adhere the back surface of the lower exposure area of the tile to the roof deck or a previously installed tile and thus, prevent wind lifting for enhanced wind performance.

According to an embodiment, the sealant (or adhesive) should have a desirable thickness to ensure that the windward edge of the tile (e.g., the bottom edge 108 of the roofing tile 100 of FIG. 1A) can be effectively secured during a wind event. According to one embodiment, the sealant or sealant line (e.g., the first sealant line 115 and/or second sealant line 120 of FIG. 1A) has a thickness of from 5 mils to 200 mils. According to one embodiment, the sealant or sealant line has a thickness of from 5 mils to 150 mils. According to one embodiment, the sealant or sealant line has a thickness of from 5 mils to 100 mils. According to one embodiment, the sealant or sealant line has a thickness of from 5 mils to 75 mils. According to one embodiment, the sealant or sealant line has a thickness of from 5 mils to 50 mils. According to one embodiment, the sealant or sealant line has a thickness of from 5 mils to 25 mils. According to one embodiment, the sealant or sealant line has a thickness of from 5 mils to 10 mils. According to one embodiment, the sealant or sealant line has a thickness of from 10 mils to 200 mils. According to one embodiment, the sealant or sealant line has a thickness of from 10 mils to 150 mils. According to one embodiment, the sealant or sealant line has a thickness of from 10 mils to 100 mils. According to one embodiment, the sealant or sealant line has a thickness of from 10 mils to 75 mils. According to one embodiment, the sealant or sealant line has a thickness of from 10 mils to 50 mils. According to one embodiment, the sealant or sealant line has a thickness of from 10 mils to 25 mils. According to one embodiment, the sealant or sealant line has a thickness of from 25 mils to 200 mils. According to one embodiment, the sealant or sealant line has a thickness of from 25 mils to 150 mils. According to one embodiment, the sealant or sealant line has a thickness of from 25 mils to 100 mils. According to one embodiment, the sealant or sealant line has a thickness of from 25 mils to 75 mils. According to one embodiment, the sealant or sealant line has a thickness of from 25 mils to 50 mils. According to one embodiment, the sealant or sealant line has a thickness of from 50 mils to 200 mils. According to one embodiment, the sealant or sealant line has a thickness of from 50 mils to 150 mils. According to one embodiment, the sealant or sealant line has a thickness of from 50 mils to 100 mils. According to one embodiment, the sealant or sealant line has a thickness of from 50 mils to 75 mils. According to one embodiment, the sealant or sealant line has a thickness of from 75 mils to 200 mils. According to one embodiment, the sealant or sealant line has a thickness of from 75 mils to 150 mils. According to one embodiment, the sealant or sealant line has a thickness of from 75 mils to 100 mils. According to one embodiment, the sealant or sealant line has a thickness of from 100 mils to 200 mils. According to one embodiment, the sealant or sealant line has a thickness of from 100 mils to 150 mils. According to one embodiment, the sealant or sealant line has a thickness of from 150 mils to 200 mils.

Suitable materials for the sealant (or adhesive) may include, but are not limited to, asphaltic sealants, polymer modified asphaltic sealants and adhesives, non-asphaltic sealants, butyl adhesives, acrylic adhesives, polyurethane adhesives, pressure sensitive adhesives, epoxies, foam adhesives, hot melt adhesives, and combinations thereof. It is noted that the terms "sealant" and "adhesive" can be used interchangeably.

In some embodiments, the sealant comprises a non-asphaltic sealant that includes at least one polymer. In one embodiment, the at least one polymer comprises a styrene polymer or copolymer. In some embodiments, the at least one polymer comprises a styrene block copolymer. Non-limiting examples of polymers include polyolefins, vinyl polymers and/or polyvinyl esters, and/or thermoplastic elastomers including, for example, polyethylene (including raw and/or recycled low density polyethylene (LDPE), linear low density polyethylene (LLDPE), and/or high density polyethylene (HDPE)), polypropylenes (e.g., isotactic polypropylene (IPP) and/or atactic polypropylene (APP/IPP)), polystyrene, polyurethane (PU/TPU), polyurea, terpolymers (e.g., a functionalized polymer with a reactive oxygen group), amorphous polyalpha olefins (APAO), amorphous polyolefins (APO), including, e.g., propylene homopolymers and/or copolymers of propylene and ethylene, copolymers of ethylene alpha-olefin, such as ethylene and octene, ethylene and hexane, and ethylene and butene, polyolefin elastomers (POE), styrene/styrenic block copolymers, including, for example, styrenic block copolymers with a hydrogenated midblock of styrene-ethylene/butylene-styrene (SEBS) or styrene-ethylene/propylene-styrene (SEPS), styrene-isoprene-styrene block copolymers (SIS), or styrene-butadiene-styrene block copolymers (SBS), ethylene vinyl acetate (EVA), polyisobutylene, polybutadiene, oxidized polyethylene, epoxy thermoplastics, raw polyvinyl butyral (PVB) and/or recycled polyvinyl butyral (rPVB), polyvinyl acetate (PVAC), poly(vinyl butyrate), poly(vinyl propionate), poly(vinyl formate), copolymers of PVAC such as EVA, and combinations thereof.

In an embodiment, the sealant further comprises at least one of (i) resins, (ii) plasticizers, (iii) tackifiers, (iv) other modifiers or (v) combinations thereof. In an embodiment, the sealant further comprises a fire-retardant material.

In an embodiment, the sealant comprises 10% to 70% by weight of filler. In an embodiment, the sealant comprises 20% to 70% by weight of filler. In an embodiment, the sealant comprises 30% to 70% by weight of filler. In an embodiment, the sealant comprises 40% to 70% by weight of filler. In an embodiment, the sealant comprises 50% to 70% by weight of filler. In an embodiment, the sealant comprises 60% to 70% by weight of filler. In an embodiment, the sealant comprises 10% to 60% by weight of filler. In an embodiment, the sealant comprises 20% to 60% by weight of filler. In an embodiment, the sealant comprises 30% to 60% by weight of filler. In an embodiment, the sealant comprises 40% to 60% by weight of filler. In an embodiment, the sealant comprises 50% to 60% by weight of filler. In an embodiment, the sealant comprises 10% to 50% by weight of filler. In an embodiment, the sealant comprises 20% to 50% by weight of filler. In an embodiment, the sealant comprises 30% to 50% by weight of filler. In an embodiment, the sealant comprises 40% to 50% by weight of filler.

According to an embodiment, a surface of the tile (e.g., the top surface 102 and/or the bottom surface 104 of the roofing tile 100 of FIGS. 1A and 1B) can be treated to improve the adhesion of the sealant (or adhesive). Examples of surface treatment include, for example, flame treatment, Corona treatment, ozone treatment, abrasion, plasma treatment, and combinations thereof.

According to one embodiment, the sealant comprises at least one of (i) a heat-activated sealant or (ii) a self-activated sealant. According to an embodiment, the heat-activated sealant exhibits an activation temperature between 50° F. and 150° F. According to an embodiment, the heat-activated sealant exhibits an activation temperature between 50° F. and 140° F. According to an embodiment, the heat-activated sealant exhibits an activation temperature between 50° F. and 130° F. According to an embodiment, the heat-activated sealant exhibits an activation temperature between 50° F. and 120° F. According to an embodiment, the heat-activated sealant exhibits an activation temperature between 50° F. and 110° F. According to an embodiment, the heat-activated sealant exhibits an activation temperature between 50° F. and 100° F. According to an embodiment, the heat-activated sealant exhibits an activation temperature between 50° F. and 90° F. According to an embodiment, the heat-activated sealant exhibits an activation temperature between 50° F. and 80° F. According to an embodiment, the heat-activated sealant exhibits an activation temperature between 50° F. and 70° F. According to an embodiment, the heat-activated sealant exhibits an activation temperature between 50° F. and 60° F. According to an embodiment, the heat-activated sealant exhibits an activation temperature between 60° F. and 150° F. According to an embodiment, the heat-activated sealant exhibits an activation temperature between 60° F. and 140° F. According to an embodiment, the heat-activated sealant exhibits an activation temperature between 60° F. and 130° F. According to an embodiment, the heat-activated sealant exhibits an activation temperature between 60° F. and 120° F. According to an embodiment, the heat-activated sealant exhibits an activation temperature between 60° F. and 110° F. According to an embodiment, the heat-activated sealant exhibits an activation temperature between 60° F. and 100° F. According to an embodiment, the heat-activated sealant exhibits an activation temperature between 60° F. and 90° F. According to an embodiment, the heat-activated sealant exhibits an activation temperature between 60° F. and 80° F. According to an embodiment, the heat-activated sealant exhibits an activation temperature between 60° F. and 70° F. According to an embodiment, the heat-activated sealant exhibits an activation temperature between 70° F. and 150° F. According to an embodiment, the heat-activated sealant exhibits an activation temperature between 70° F. and 140° F. According to an embodiment, the heat-activated sealant exhibits an activation temperature between 70° F. and 130° F. According to an embodiment, the heat-activated sealant exhibits an activation temperature between 70° F. and 120° F. According to an embodiment, the heat-activated sealant exhibits an activation temperature between 70° F. and 110° F. According to an embodiment, the heat-activated sealant exhibits an activation temperature between 70° F. and 100° F. According to an embodiment, the heat-activated sealant exhibits an activation temperature between 70° F. and 90° F. According to an embodiment, the heat-activated sealant exhibits an activation temperature between 70° F. and 80° F. According to an embodiment, the heat-activated sealant exhibits an activation temperature between 80° F. and 150° F. According to an embodiment, the heat-activated sealant exhibits an activation temperature between 80° F. and 140° F. According to an embodiment, the heat-activated sealant exhibits an activation temperature between 80° F. and 130° F. According to an embodiment, the heat-activated sealant exhibits an activation temperature between 80° F. and 120° F. According to an embodiment, the heat-activated sealant exhibits an activation temperature between 80° F. and 110° F. According to an embodiment, the heat-activated sealant exhibits an activation temperature between 80° F. and 100° F. According to an embodiment, the heat-activated sealant exhibits an activation temperature between 80° F. and 90° F. According to an embodiment, the heat-activated sealant exhibits an activation temperature between 90° F. and 150° F. According to an embodiment, the heat-activated sealant exhibits an activation temperature between 90° F.

and 140° F. According to an embodiment, the heat-activated sealant exhibits an activation temperature between 90° F. and 130° F. According to an embodiment, the heat-activated sealant exhibits an activation temperature between 90° F. and 120° F. According to an embodiment, the heat-activated sealant exhibits an activation temperature between 90° F. and 110° F. According to an embodiment, the heat-activated sealant exhibits an activation temperature between 90° F. and 100° F. According to an embodiment, the heat-activated sealant exhibits an activation temperature between 100° F. and 150° F. According to an embodiment, the heat-activated sealant exhibits an activation temperature between 100° F. and 140° F. According to an embodiment, the heat-activated sealant exhibits an activation temperature between 100° F. and 130° F. According to an embodiment, the heat-activated sealant exhibits an activation temperature between 100° F. and 120° F. According to an embodiment, the heat-activated sealant exhibits an activation temperature between 100° F. and 110° F. According to an embodiment, the heat-activated sealant exhibits an activation temperature between 110° F. and 150° F. According to an embodiment, the heat-activated sealant exhibits an activation temperature between 110° F. and 140° F. According to an embodiment, the heat-activated sealant exhibits an activation temperature between 110° F. and 130° F. According to an embodiment, the heat-activated sealant exhibits an activation temperature between 110° F. and 120° F. According to an embodiment, the heat-activated sealant exhibits an activation temperature between 120° F. and 150° F. According to an embodiment, the heat-activated sealant exhibits an activation temperature between 120° F. and 140° F. According to an embodiment, the heat-activated sealant exhibits an activation temperature between 120° F. and 130° F. According to an embodiment, the heat-activated sealant exhibits an activation temperature between 130° F. and 150° F. According to an embodiment, the heat-activated sealant exhibits an activation temperature between 130° F. and 140° F. According to an embodiment, the heat-activated sealant exhibits an activation temperature between 140° F. and 150° F.

In an embodiment, the sealant (or adhesive) exhibits a minimum activation temperature (° F.) (tan δ>1) of less than 50° F. In an embodiment, the sealant (or adhesive) exhibits a minimum activation temperature (° F.) (tan δ>1) of less than 40° F. In an embodiment, the sealant (or adhesive) exhibits a minimum activation temperature (° F.) (tan δ>1) of less than 30° F. In an embodiment, the sealant (or adhesive) exhibits a minimum activation temperature (° F.) (tan δ>1) of less than 20° F. In an embodiment, the sealant (or adhesive) exhibits a minimum activation temperature (° F.) (tan δ>1) of 0° F. to 50° F. In an embodiment, the sealant (or adhesive) exhibits a minimum activation temperature (° F.) (tan δ>1) of 0° F. to 40° F. In an embodiment, the sealant (or adhesive) exhibits a minimum activation temperature (° F.) (tan δ>1) of 0° F. to 30° F. In an embodiment, the sealant (or adhesive) exhibits a minimum activation temperature (° F.) (tan δ>1) of 0° F. to 20° F. According to these embodiments, the sealant (or adhesive) promotes low temperature adhesion, which can thus enhance bonding and/or low temperature wind resistance when the roofing systems are installed at cold temperatures. Non-limiting examples of non-asphaltic sealants that exhibit minimum activation temperatures (° C.) (tan δ>1) of −10° C. to −5° C. (14° F. to 23° F.) according to embodiments of the invention include, for example, LORD® HM-17, which is a styrene-based adhesive available from LORD Corporation, Cary, N.C.; SWIFT®MELT 81570, which is a styrene-based adhesive available from H.B. Fuller, St. Paul Minn.; PS-2200 PSA, which comprises a styrene block copolymer that is available from Pro Pack Solutions, Inc., Loganville, Ga.; and Cattie C52-810C PLW, which comprises a styrene block copolymer that is available from Cattie Adhesives, Quakertown, Pa.

According to an embodiment, the sealant (or adhesive) has a viscosity that prevents bleeding at high roof temperatures, such as those greater than, e.g., 180° F. For example, according to one embodiment, the sealant (or adhesive) exhibits a viscosity of 100 to 10,000 Pa-S, at around 180° F. According to another embodiment, the sealant (or adhesive) exhibits a viscosity of 1,000 to 10,000 Pa-S, at around 180° F. According to an embodiment, the sealant (or adhesive) exhibits a viscosity of 2,500 to 10,000 Pa-S, at around 180° F. According to an embodiment, the sealant (or adhesive) exhibits a viscosity of 5,000 to 10,000 Pa-S, at around 180° F. According to an embodiment, the sealant (or adhesive) exhibits a viscosity of 7,500 to 10,000 Pa-S, at around 180° F. According to an embodiment, the sealant (or adhesive) exhibits a viscosity of 1,000 to 5,000 Pa-S, at around 180° F. According to an embodiment, the sealant (or adhesive) exhibits a viscosity of 2,500 to 5,000 Pa-S, at around 180° F.

Figure 5A:
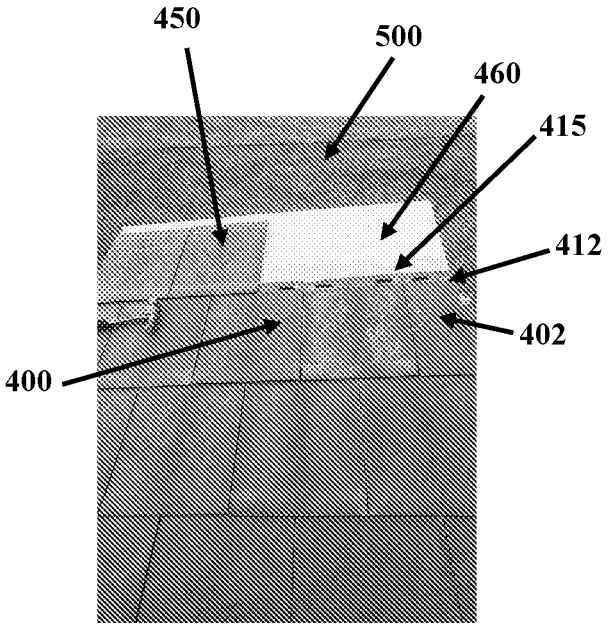
FIG. 5A is a photograph of a roofing system according to an embodiment of the invention.
Figure 5B:
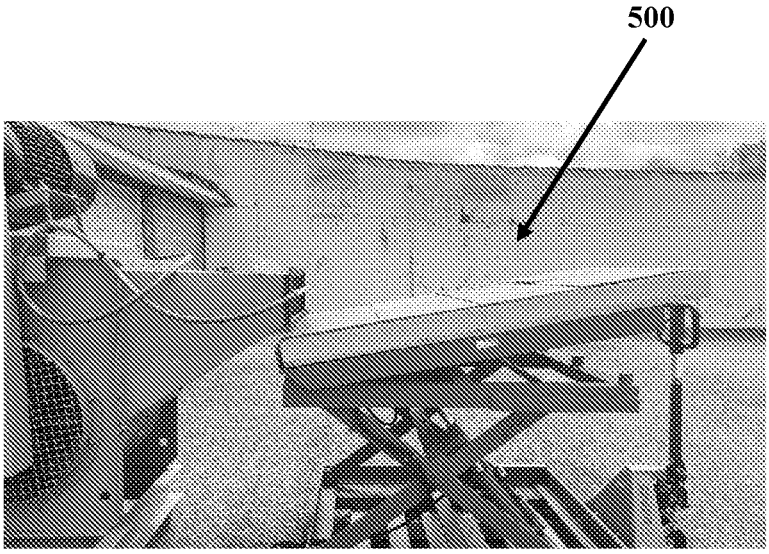
FIG. 5B is a photograph of the roofing system of FIG. 5A that is subjected to a wind test according to embodiments of the invention.

Embodiments of the invention provide roofing systems that exhibit increased wind uplift resistance, as measured according to ASTM D3161 (see, e.g., FIG. 5B). According to one embodiment, the roofing system passes the ASTM D3161 test at 110 mph for 2 hours.

Figure 6A:
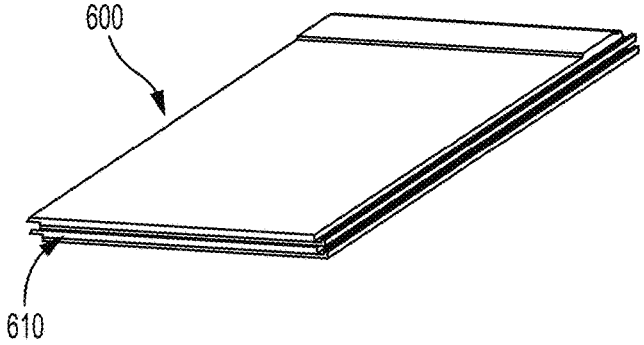
FIG. 6A is an illustration of a stack of roofing tiles, with each roofing tile having at least one sealant line, according to an embodiment of the invention.
Figure 6B:
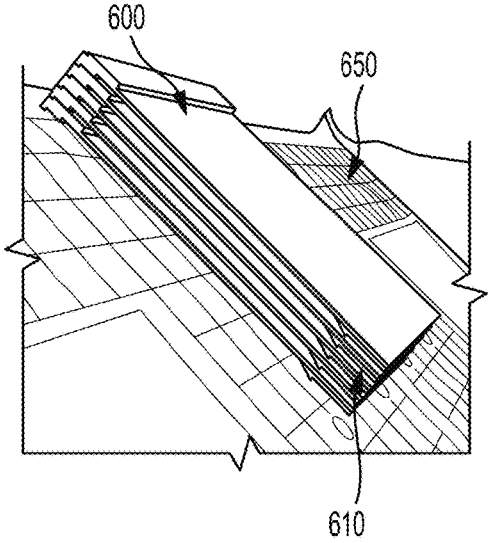
FIG. 6B is an illustration of a stack of roofing tiles positioned on a sloped roof, with each roofing tile having at least one sealant line, according to an embodiment of the invention.

Embodiments of the invention provide roofing tiles (including, e.g., non-interlocking tiles) with enhanced wind performance using sealants that can be activated at certain temperatures when the tiles are exposed to direct sunlight after installation (i.e., heat-activated sealants). To help the release of the roofing tiles from a package or stack of tiles, including where the roofing tiles are stacked on top of each other without sliding on a sloped roof (see, e.g., FIGS. 6A and 6B), a release agent or a parting agent that has low affinity to the sealant can be applied. For example, as shown in FIGS. 6A and 6B, a stack 600 of roofing tiles 610 is illustrated, such that, in FIG. 6B, the stack 600 of roofing tiles 610 is placed on top of a sloped roof 650. According to this embodiment, the roofing tiles or stack 600 of roofing tiles 610 can be stored in an unconditioned warehouse (see, e.g., FIG. 6A), or the roofing tiles can be transported in hot climates to the jobsite in direct sunlight, such that, for example, a stack 600 of roofing tiles 610 can be placed on top of a sloped roof 650 (see, e.g., FIG. 6B), while enabling the roofing tiles to be separated from the stack with ease for installation.

Figure 7A:
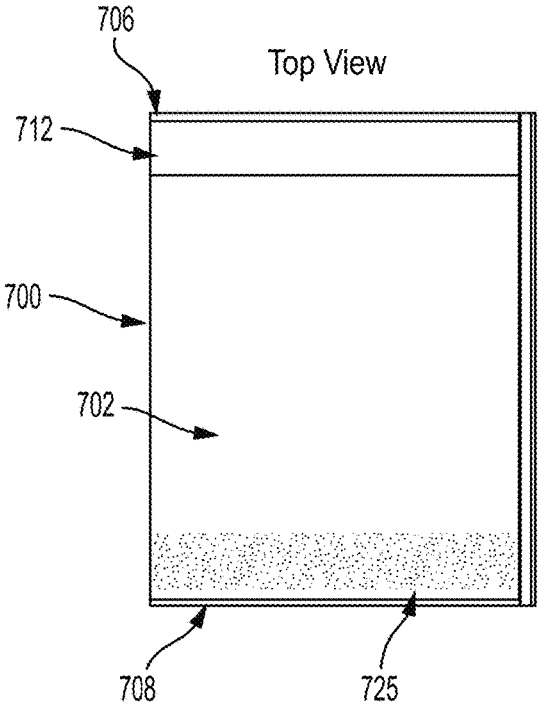
FIG. 7A is an illustration of a top view of a roofing tile having a release agent according to an embodiment of the invention.
Figure 7B:
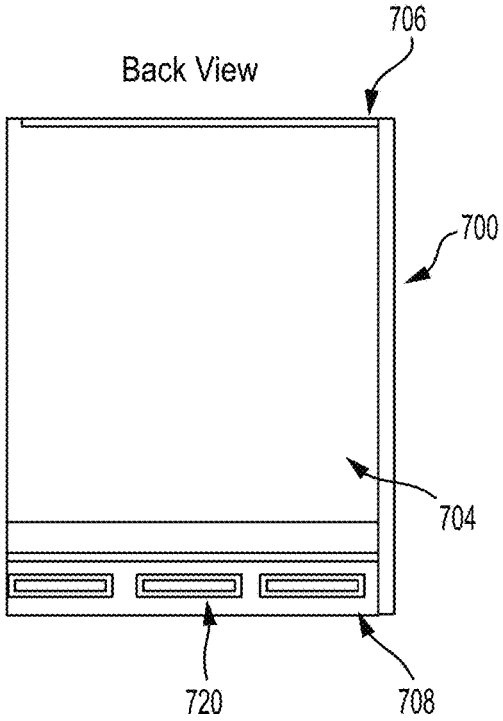
FIG. 7B is an illustration of a back or bottom view of a roofing tile having at least one sealant line according to an embodiment of the invention.

FIGS. 7A and 7B illustrate a roofing tile 700 according to an embodiment of the invention that includes both a sealant line and a release agent (or parting agent). According to this embodiment, the roofing tile 700 includes a front surface 702, a back surface 704, a top edge 706, and a bottom edge 708. As also shown in FIG. 7A, the roofing tile 700 includes a headlap 712 near the top edge 706. As further shown in the embodiment of FIG. 7A, the roofing tile 700 includes a release agent 725 on the front surface 702 near the bottom edge 708 of the roofing tile 700. As shown in the embodiment of FIG. 7B, the roofing tile 700 also includes a sealant line 720 on the back surface 704 near the bottom edge 708 of the roofing tile 700. According to this embodiment, the release agent (or parting agent) 725 is added to the front surface 702 of the roofing tile 700 in a position where a sealant from a roofing tile positioned above this roofing tile 700 will make contact with the release agent 725 (e.g., a roofing tile having a sealant disposed on the back surface, as in the embodiment of FIG. 7B). For example, FIG. 7B depicts the case where a sealant 720 is placed on the back surface 704 of the roofing tile 700 near the bottom (or windward) edge 708. In this case, the release agent (or parting agent) 725 can be located on the front surface 702 of the roofing tile 700 near the bottom edge 708 of the roofing tile 700 (see, e.g., FIG. 7A). Although the embodiment of FIG. 7B illustrates only a single sealant line 720, two or more sealant lines could be included. In addition, although the embodiment of FIG. 7B illustrates the sealant line 720 comprising a plurality of spaced apart lines or dots of sealant (or adhesive), i.e., the sealant line 720 is discontinuous, the sealant for the sealant line 720 could also be provided as a single line of sealant, multiple lines of sealant, or combinations thereof.

Figure 8A:
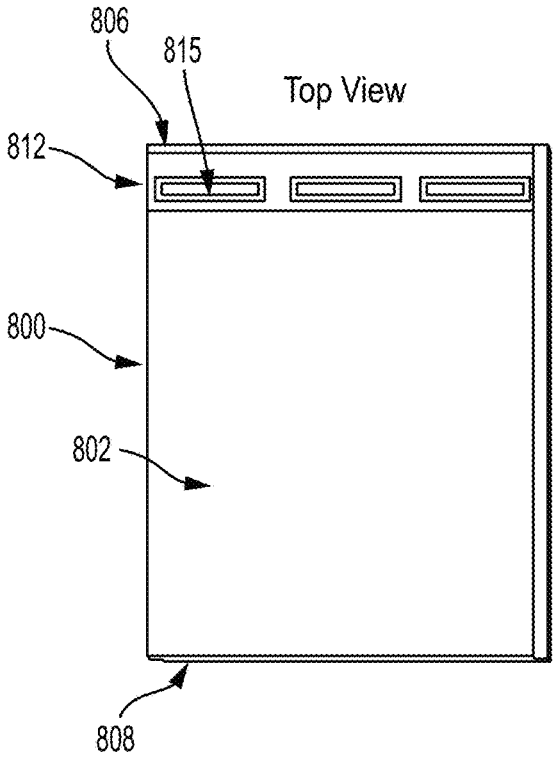
FIG. 8A is an illustration of a top view of a roofing tile having at least one sealant line according to an embodiment of the invention.
Figure 8B:
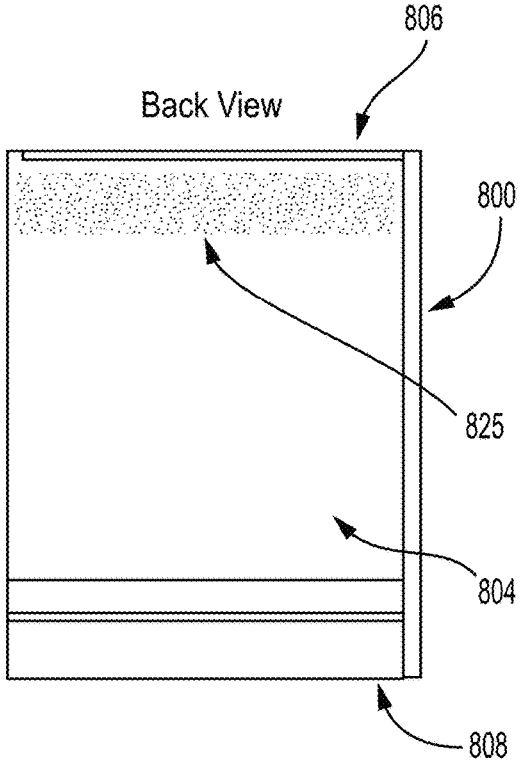
FIG. 8B is an illustration of a back or bottom view of a roofing tile having a release agent according to an embodiment of the invention.

FIGS. 8A and 8B illustrate a roofing tile 800 according to another embodiment of the invention that includes both a sealant line and a release agent (or parting agent). According to this embodiment, the roofing tile 800 includes a front surface 802, a back surface 804, a top edge 806, and a bottom edge 808. As also shown in FIG. 8A, the roofing tile 800 includes a headlap 812 near the top edge 806. As further shown in the embodiment of FIG. 8A, the roofing tile 800 includes a sealant line 815 on the front surface 802 in the area of the headlap 812. As shown in the embodiment of FIG. 8B, the roofing tile 800 also includes a release agent 825 on the back surface 804 near the top edge 806 of the roofing tile 800. According to this embodiment, since the sealant line 815 is located on the front surface 802 of the roofing tile 800 near the top edge 806 in the area of the headlap 812 (see, e.g., FIG. 8A), the release agent (or parting agent) 825 is located on the back surface 804 of the roofing tile 800 along the top edge 806 (see, e.g., FIG. 8B), so that the sealant(s) can be effectively released from a stack of roofing tiles (see, e.g., FIGS. 6A and 6B). Although the embodiment of FIG. 8A illustrates only a single sealant line 815, two or more sealant lines could be included. In addition, although the embodiment of FIG. 8A illustrates the sealant line 815 comprising a plurality of spaced apart lines or dots of sealant (or adhesive), i.e., the sealant line 815 is discontinuous, the sealant for the sealant line 815 could also be provided as a single line of sealant, multiple lines of sealant, or combinations thereof.

According to some embodiments, the release agent or parting agent has low affinity to the sealant, even at slightly elevated temperatures. According to an embodiment, the release agent or parting agent comprises a material with relatively low surface energy, such as, e.g., silicone, siliconate dispersions, fluoropolymers, soaps, wax, metal salts, or surfaces with a texture(s) to create a low surface energy effect. According to another embodiment, the release agent or parting agent is applied to a surface of a roofing tile via a method such as, e.g., roll coating, transfer coating, spraying, curtain coating, extrusion, electrostatic spray, printing, wheel coater, dip coating, spinning coating, die coating, or combinations thereof.

According to another embodiment, the release agent or parting agent can have additional functionality, such as, e.g., a temporary protective coating to the exposed surface of the roofing tile to prevent scratches or discoloration by contaminants. According to one embodiment, the release or parting agent can be applied to a larger area or to the entire surface of the roofing tiles to serve as the protective surface. According to another embodiment, the release or parting agent can be slowly removed from the roofing tiles by exposure to UV radiation and/or to rain runoff, such that the release or parting agent will not impact the long-term aesthetics of the roofing tiles.

Embodiments of the invention provide roofing tiles and methods of adding heat-activated or self-activated sealants to roofing tiles (including, e.g., non-interlocking and/or polymeric tiles) having a release agent (or parting agent) for ease of separation from a stack of roofing tiles (see, e.g., FIGS. 6A and 6B). According to embodiments, the addition of a sealant (including, e.g., heat-activated or self-activated sealants) is to enhance wind performance, and the release agent can be added to enable the release of individual tiles from a stack of tiles during tile installation on a roof.

Another embodiment of this invention pertains to a method of installing roofing tiles onto a roofing substrate having a roofing surface. The method comprises (a) obtaining a first roofing tile, the first roofing tile having a front surface, a back surface, a top edge, and a bottom edge, (b) obtaining a second roofing tile, the second roofing tile having a front surface, a back surface, a top edge, and a bottom edge, (c) applying at least one sealant line to (i) the back surface of the second roofing tile in an area that overlays the first roofing tile, (ii) the front surface of the first roofing tile in an area in which the second roofing tile overlays the first roofing tile, or (iii) both (i) and (ii), and (d) installing the first and second roofing tiles to the roofing surface, such that the second roofing tile overlays at least a portion of the first roofing tile. The at least one sealant line is configured to adhere the second roofing tile to the first roofing tile, and the second roofing tile does not adhere to the roofing surface via a sealant.

According to one embodiment, during the method of installing roofing tiles onto a roofing substrate having a roofing surface, an installation device can be used to automatically apply lines or dots of sealant (or adhesive) along a headlap of a respective roofing tile(s) to thus apply the sealant (or adhesive) prior to the installation, and preferably, during manufacturing of the roofing tile(s). According to another embodiment, during the method of installing roofing tiles onto a roofing substrate having a roofing surface, an installation device can be used to automatically apply lines or dots of sealant (or adhesive) along a headlap of a respective roofing tile(s) to thus apply the sealant (or adhesive) prior to the installation of the next course of roofing tiles. According to one embodiment, the installation device can automatically track the headlap area of the respective roofing tile(s) along the course of the roofing tiles by means of, for example, contact tracking, distance sensors, optical sensors, or by being mechanically attached to the roofing surface, to thereby apply lines or dots of sealant (or adhesive) at a predetermined distance. According to an embodiment, the installation device is mobile and can follow the headlap area of the respective roofing tile(s) for accurate sealant application. According to another embodiment, the installation device can be used to apply snap lines to the next course of roofing tiles.

According to one embodiment, the method further comprises applying a release agent to at least one of the first roofing tile and the second roofing tile. In some embodiments, the step of applying the release agent comprises applying the release agent to (i) the front surface of the at least one of the first roofing tile and the second roofing tile, (ii) the back surface of the at least one of the first roofing tile and the second roofing tile, or (iii) both (i) and (ii). In an embodiment, the release agent has a low affinity to the at least one sealant line.

According to embodiments of the invention, in addition to, or alternatively to, the above-discussed lines of sealant (or adhesive), other means or mechanisms can be used to install the roofing tiles to the roofing substrate having the roofing surface to thus prevent the windward edge from lifting during a wind event. According to an embodiment, mechanical means can be used to install the roofing tiles to the roofing surface, such as, e.g., velcro, magnets, suction cups, U-hooks, and combinations thereof. According to one embodiment, magnets are used to install the roofing tiles to the roofing surface. According to this embodiment, the magnets need to be strategically placed on the bottom side of the windward edge of the roofing tile (see, e.g., bottom edge 108 of the roofing tile 100 of FIG. 1A), during manufacturing of the tiles. According to this embodiment, during installation of the roofing tiles, when the course below is secured using roofing nails, the course above will have magnets lining up with the nails to create a bond. According to another embodiment, alternative or additional magnets can be placed in the headlap area of the tile (see, e.g., headlap 112 of the roofing tile 100 of FIG. 1A) to form a bond upon contact with the overlying roofing tile(s). According to yet another embodiment, a metallic strip, a metallic surface, and/or metallic powder can be added to the headlap area of the tile (see, e.g., headlap 112 of the roofing tile 100 of FIG. 1A), such that magnets can form the attachment to prevent wind uplift. According to one embodiment, to be effective, the magnetic load should be no less than 12 lbs.

According to another embodiment, the mechanical means to install the roofing tiles to the roofing substrate having the roofing surface include suction cups and/or U-Hooks. According to one embodiment, the suction cups and/or U-Hooks include a nailing tab that can also be used with roofing nails when securing the roofing tiles of a roofing system to a roofing substrate having a roofing surface. According to one embodiment, when suction cups are used, a course of roofing tiles above another course of roofing tiles is placed over a suction cup creating a vacuum tight seal. According to an embodiment, a low-profile suction cup is used so that the course of roofing tiles above another course of roofing tiles sits flush with this course of roofing tiles below.

Figure 2:
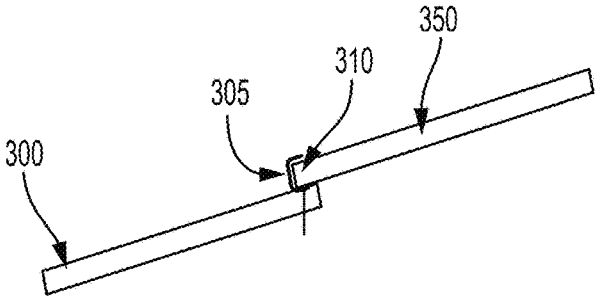
FIG. 2 is an illustration of a roofing system that includes at least two roofing tiles according to another embodiment of the invention.

According to another embodiment, U-hooks are used to install and attach the roofing tiles, such that the U-hooks prevent the windward edge from lifting. For example, FIG. 2 illustrates one embodiment of a U-Hook 305 that is used between a course of roofing tiles. As shown in the embodiment of FIG. 2, a second roofing tile 350 is attached to a first roofing tile 300 via a U-hook 305, which thus prevents the windward edge (e.g., edge 310 of the second roofing tile 350) from lifting during a wind event.

According to another embodiment, the wind uplift performance of roofing tiles, including, e.g., non-interlocking roofing tiles, can be improved by applying foam adhesives between the lower part of the exposed area of the respective roofing tile and a roofing surface (e.g., roof deck substrate having a roofing surface or previously installed roofing tile), such that the lower part of the roofing tile will be adhered to the roofing substrate having a roofing surface or previously installed roofing tile to prevent wind lifting. According to one embodiment, foam adhesives are sprayed onto a roofing surface (e.g., roof deck substrate that is covered with a suitable underlayment or previously installed roofing tile) in an area in which the backside of the tile exposure area can make contact. According to an embodiment, the foam adhesives are sprayed onto the roofing substrate having a roofing surface or previously installed roofing tile immediately before the application or installation of the roofing tiles, such that the roofing tiles set against the foam adhesives and ensure adequate adhesion. Thereafter, the roofing tile(s) can either be nailed at the headlap or the same foam adhesives can be used to secure the headlap portion of the tile to further reduce the need of fasteners.

According to yet another embodiment, the roofing substrate comprises an underlayment having areas with pre-applied sealants (or adhesives), such that the backside of the tile exposure area of respective roofing tiles will contact these pre-applied sealants to thus secure the roofing tile(s) and prevent wind lifting. According to one embodiment, the pre-applied sealants (or adhesives) are applied in a stripe with a discontinuous line of dots, which are formed during the making of the underlayment. According to another embodiment, the backside of the underlayment contains areas of release coating that mirrors the location of the pre-applied sealants (or adhesives), such that the sealants (or adhesives) can be released without sticking when the roll of underlayment is unrolled for application onto a roof. According to some embodiments, the location of the pre-applied sealants or sealant lines can also serve as the alignment line for tile courses, such that there will be no need to snap alignment lines, which thereby reduces the time of installation.

According to another embodiment, the wind performance of the roofing tiles can be enhanced by designing the roofing tiles to have ribbed backing, which will allow for ventilation and create pressure equalization to thereby minimize the wind uplift force and/or pressure. According to another embodiment, the shape of the windward edge of the roofing tiles can be designed to be rounded on the bottom edge to reduce the wind induced uplift pressure. For example, the windward edge of the roofing tiles could be in the shape of an inverse wing from an airplane. According to this embodiment, the shape of the windward edge of the roofing tiles could minimize the wind uplift generated by, for example, negative pressure or wind induced uplift pressure due to flow separation that is created after the windward edge of the roofing tile

EXAMPLES

Specific embodiments of the invention will now be demonstrated by reference to the following examples. It should be understood that these examples are disclosed by way of illustrating the invention and should not be taken in any way to limit the scope of the present invention.

Example 1

A non-interlocking, synthetic roofing tile was obtained having a dimension of 22"×12" and a nominal thickness of 1/2" (New SyntheticSlate™ roofing tile, commercially available from Polysand (Ontario, CA)). This non-interlocking, synthetic roofing tile was tested for its wind performance using the ASTM D3161 method. In particular, roofing tiles were installed over a ½" plywood roof deck covered by two layers of 30# roofing felt (i.e., asphalt-saturated paper). The roofing tiles were installed by nailing the tile(s) with two 1¼" roofing nails at the nailing area of the tile(s). The exposure length of the installed tile(s) was 9½" and the tiles were installed with a ⅜" gap between adjacent tiles according to the installation instructions.

Figure 3A:
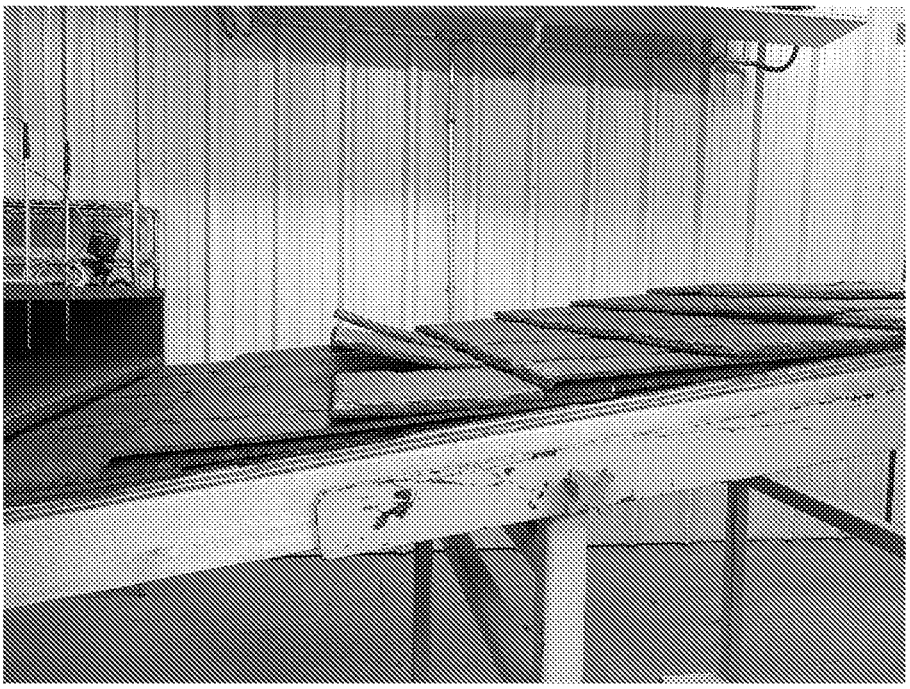
FIGS. 3A and 3B are photographs of a roofing system that is subjected to a wind test according to embodiments of the invention.
Figure 3B:
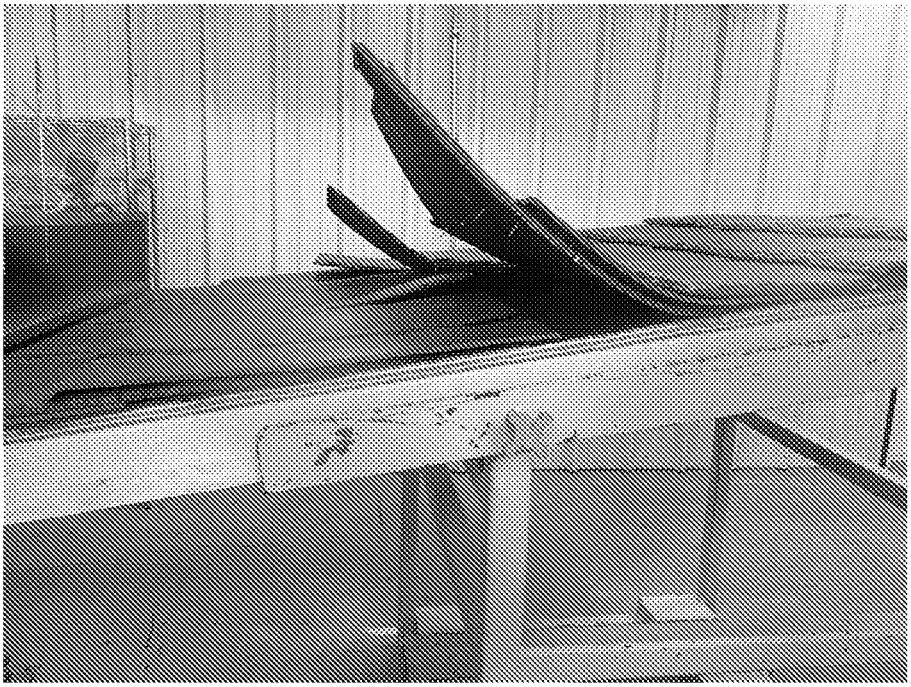

The installed tile system was then subjected to the wind test described in ASTM D3161 at a wind speed of 110 mph (Class F) for two hours. The tiles were found to lift significantly at the windward edge by the wind force soon after the wind speed reached 110 mph (see, e.g., FIG. 3A). As the test progressed, the lifting became more severe and eventually, the tiles showed failure by pulling out the fasteners/nails as the tiles were deformed by the wind load (see, e.g., FIG. 3B). As a result, these non-interlocking, synthetic roofing tiles failed the ASTM D3161 wind test at 110 mph.

Example 2

Figure 4A:
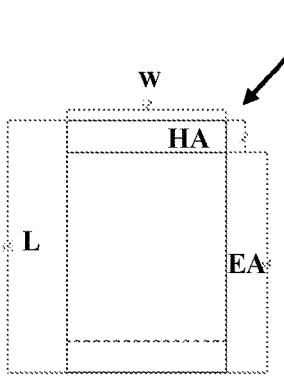
FIG. 4A is an illustration of a top view of a roofing tile according to an embodiment of the invention.
Figure 4B:
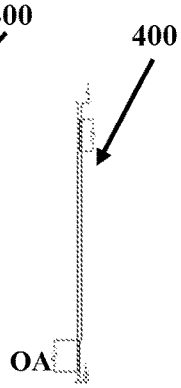
FIG. 4B is an illustration of the side view of the roofing tile of FIG. 4A according to an embodiment of the invention.
Figure 4C:
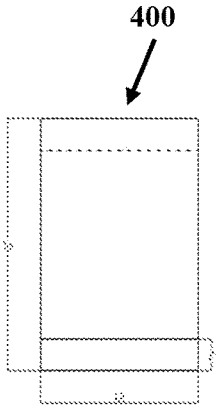
FIG. 4C is an illustration of the back view of the roofing tile of FIG. 4A according to an embodiment of the invention.
Figure 4D:
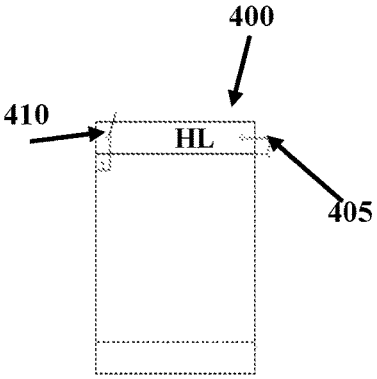
FIG. 4D is an illustration of the nailing location(s) of the roofing tile of FIG. 4A according to an embodiment of the invention.

A non-interlocking, synthetic roofing tile comprising 72 wt % of sand (mason sand) and 24 wt % of MDPE (medium-density polyethylene) (DPDA-3135 from Dow Chemical (Midland, Mich.)) was produced by mixing the sand and the MDPE in an extruder to evenly blend and melt into an extrudate, which was then placed over an aluminum mold followed by compression molding using a 90-ton press. The produced and finished synthetic tile, which is illustrated as tile 400 in FIGS. 4A-4D, had a dimension of 16"×12" (L×W in FIG. 4A) with (i) a 2" recessed/stepped headlap area (HA in FIG. 4A) for nailing and (ii) a 2" stepped overlapping area in the exposure end (OA in FIG. 4B) to cover the nailing area (see, e.g., FIG. 4D). The tile has an exposure area (EA in FIG. 4A) of 14"×12" when installed and a thickness of ¾" in the exposure area. The tiles were installed by nailing at the preferred nailing locations (405 and 410 in FIG. 4D) using two 1¼" roofing nails per tile (see, e.g., tile 400 of FIGS. 4A-4D). The installed synthetic tiles had a relatively low profile and a smooth surface, which was assumed to provide better wind performance when compared to other synthetic tiles, such as, e.g., those discussed above in Example 1.

Figure 4E:
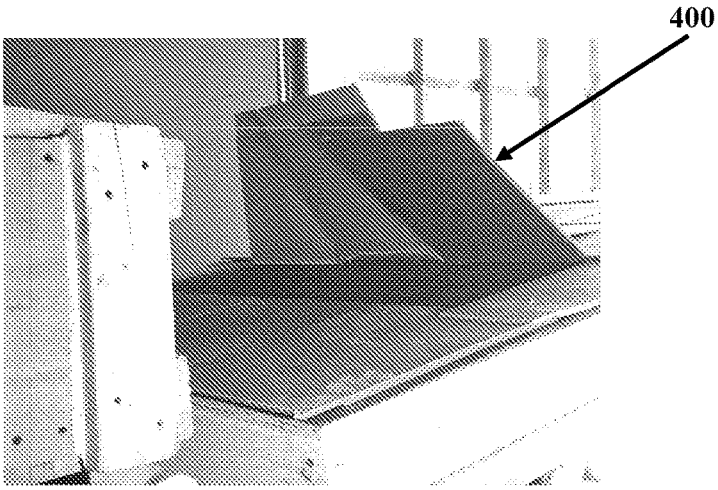
FIG. 4E is a photograph of a roofing system that includes the roofing tile as illustrated in FIGS. 4A-4D and is subjected to a wind test according to embodiments of the invention.

The prepared and installed synthetic tiles were then tested for their wind performance by conducting the same ASTM D3161 wind test as Example 1 on a test roof deck covered with a synthetic or polymer underlayment and by installing/nailing the synthetic tiles to the test roof deck using two nails per tile. The installed roof deck was then subjected to the 110 mph wind test in a calibrated wind tunnel at ambient temperature. It was soon noticed that the tiles quickly failed once the wind reached the 110 mph target speed, by significant lifting and breaking along the nailing area (see, e.g., FIG. 4E).

Example 3

The same synthetic tiles as produced according to the method of Example 2 were tested for their wind performance, except that a pressure-sensitive sealant (or adhesive) (3M VHB double-sided tape) was applied between the overlapping area of the nailing zone (see, e.g., OA of tile 400 of FIG. 4B) and the stepped headlap zone (see, e.g., HA of tile 400 of FIG. 4A) (see also, e.g., FIG. 5A). In particular, as shown in FIG. 5A, a first roofing tile (e.g., tile 400 of FIGS. 4A-4D) was installed onto a roofing substrate having a roofing surface 460. The first roofing tile 400 included the pressure-sensitive sealant (or adhesive) 415 on the top surface 402 of the first roofing tile 400 in the area of the headlap 412. A second roofing tile 450 was installed to overlay the first roofing tile 400 in the area of the headlap 412 in which the pressure-sensitive sealant (or adhesive) 415 was applied. The roofing system 500 was then tested by the same ASTM D3161 wind test of Examples 1 and 2 at 110 mph for 2 hours. The installed system 500 was found to pass the wind test without noticeable lifting or bending and/or any significant movements (see, e.g., FIG. 5B). The roofing tile(s) (see, e.g., tiles 400 and 450 of FIG. 5A) was found to have greatly enhanced wind performance by having the windward edge held down using the sealants (or adhesives) to prevent any wind induced damage (see, e.g., FIG. 5B). The roofing tile(s) with the applied sealants (or adhesives) in the windward edge was able to pass the wind test at 110 mph for 2 hours.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A roofing tile comprising:

(a) a front surface;

(b) a back surface that is opposite to the front surface;

(c) a first side edge;

(d) a second side edge that is opposite to the first side edge;

(e) a top edge;

(f) a bottom edge that is opposite to the top edge;

(g) at least one sealant line configured to adhere the roofing tile to another roofing tile, the at least one sealant line being applied to (i) the back surface of the roofing tile, (ii) the front surface of the roofing tile, or (iii) both (i) and (ii); and (h) a release agent, wherein the release agent is applied to (i) the front surface of the roofing tile in only an area that is opposite to the at least one sealant line, (ii) the back surface of the roofing tile in only an area that is opposite to the at least one sealant line, or (iii) both (i) and (ii), wherein the roofing tile comprises a non-interlocking, synthetic tile, with the roofing tile being non-interlocking along the first side edge and the second side edge, and wherein the roofing tile comprises a thermoplastic material and a filler.

2. The roofing tile according to claim 1, wherein the at least one sealant line is applied to (i) the back surface of the roofing tile in an area that is adjacent to the bottom edge of the roofing tile, (ii) the front surface of the roofing tile in an area that is adjacent to the top edge of the roofing tile, or (iii) both (i) and (ii).

3. The roofing tile according to claim 1, wherein the at least one sealant line comprises at least one of (i) a heat-activated sealant or (ii) a self-activated sealant.

4. The roofing tile according to claim 1, wherein the thermoplastic material comprises at least one of a thermoplastic polymer, an elastomer, a rubber, a copolymer, a polyolefin, or a combination thereof.

5. The roofing tile according to claim 1, wherein the filler comprises at least one of sand, calcium carbonate, stone dust, wood dust, or a combination thereof.

6. The roofing tile according to claim 1, further comprising an additive.

7. The roofing tile according to claim 6, wherein the additive comprises at least one of a fire retardant, a colorant, a pigment, a stabilizer, an impact modifier, a UV absorber, an anti-oxidizer, a processing aid, or a combination thereof.

8. The roofing tile according to claim 1, wherein the release agent has a low affinity to the at least one sealant line.

9. The roofing tile according to claim 1, wherein the release agent comprises one or more of a silicone, siliconate dispersions, a fluoropolymer, a soap, a wax, a metal salt, or a surface with a texture to create a low surface energy effect.

10. The roofing tile according to claim 1, wherein the front surface of the roofing tile is free of a sealer.

11. The roofing tile according to claim 1, wherein the at least one sealant line comprises a discontinuous line.

12. The roofing tile according to claim 1, wherein the at least one sealant line has a thickness of from 5 mils to 200 mils.

13. The roofing tile according to claim 1, wherein the at least one sealant line exhibits a minimum activation temperature (° F.) (tan $\delta>1$) of less than 40° F.

14. The roofing tile according to claim 1, wherein the at least one sealant line comprises a heat-activated sealant that exhibits an activation temperature between 70° F. and 140° F.

15. The roofing tile according to claim 1, wherein the at least one sealant line comprises at least one of an asphaltic sealant, a polymer modified asphaltic sealant, a butyl adhesive, an acrylic adhesive, a polyurethane adhesive, a pressure sensitive adhesive, an epoxy, a foam adhesive, a hot melt adhesive, and combinations thereof.

16. The roofing tile according to claim 1, wherein the top edge of the roofing tile extends from the first side edge to the second side edge of the roofing tile, and the bottom edge of the roofing tile extends parallel to the top edge from the first side edge to the second side edge of the roofing tile.

17. The roofing tile according to claim 16, wherein the first side edge of the roofing tile extends parallel to the second side edge of the roofing tile from the top edge to the bottom edge of the roofing tile.

* * * * *